United States Patent [19]

Lemper

[11] Patent Number: 4,799,535

[45] Date of Patent: Jan. 24, 1989

[54] MODULAR CONTINUOUS SLAB CASTERS AND THE LIKE

[76] Inventor: Herbert Lemper, 130 Canterbury Rd., McMurray, Pa. 15317

[21] Appl. No.: 147,222

[22] Filed: Jan. 22, 1988

Related U.S. Application Data

[63] Continuation of Ser. No. 36,407, Apr. 9, 1987, abandoned.

[51] Int. Cl.[4] ..... B22D 11/00

[52] U.S. Cl. ..... 164/416; 164/418; 164/438; 164/442; 164/426

[58] Field of Search ..... 164/418, 416, 438, 437, 164/441, 442, 425, 426

[56] References Cited

U.S. PATENT DOCUMENTS

| | | | |
|---|---|---|---|
| 2,698,467 | 1/1955 | Tarquinee et al. . | |
| 2,814,843 | 12/1957 | Savage et al. . | |
| 2,920,359 | 1/1960 | Easton et al. . | |
| 3,528,485 | 9/1970 | Vogel . | |
| 3,563,298 | 2/1971 | Stauffer et al. . | |
| 3,580,325 | 5/1971 | Schrewe . | |
| 3,623,533 | 11/1971 | Khorev et al. . | |
| 3,718,177 | 2/1973 | Wagner, Jr. . | |
| 3,753,461 | 8/1973 | Gallucci et al. . | |
| 3,765,470 | 10/1973 | Huber . | |
| 3,776,298 | 12/1973 | Vogt | 164/154 |
| 3,794,107 | 2/1974 | Bollig et al. . | |
| 4,023,612 | 5/1977 | Jackson . | |
| 4,129,173 | 12/1978 | Scheurecker et al. | 164/442 |
| 4,502,527 | 3/1985 | Brewer | 164/418 |
| 4,532,981 | 8/1985 | Hargassner et al. | 164/483 |

*Primary Examiner*—Kuang Y. Lin

*Attorney, Agent, or Firm*—Webb, Burden, Ziesenheim & Webb

[57] ABSTRACT

A modular slab caster or the like is provided having a flat foundation mat supporting a ladle turret module, a tundish module, a mold oscillator module, at least one adjustable segment module, a straightening module, a starting bar handling and charging module and a utility module, all on said foundation mat and rapidly connected and disconnected from one another to provide rapid installation of modules.

20 Claims, 10 Drawing Sheets

MODULAR CONTINUOUS SLAB CASTERS AND THE LIKE

This application isa continuation of application Ser. No. 036,407, filed Apr. 9, 1987, now abandoned.

This invention relates to modular continuous slab casters and the like and particularly to a continuous caster made up of readily interchangeable caster segments, all assembled on a flat foundation mat.

Continuous casters and particularly continuous slab casters have been used for several decades to convert molten steel to a continuous slab of solid metal without the intermediate steps of forming ingots, reheating ingots and rolling the ingots to slabs. There have been a multitude of designs for such continuous casters and for the many parts out of which they are assembled. They have, however, remained as immense projects requiring months and years of construction and assembly at the location of the plant and millions of dollars in costs. In the past such continuous casters have involved vast excavations, with endless forming work and concrete casting in order to produce the necessary mammoth foundations riddled with tunnels, rooms, pipe and conduit. In such prior art casters miles of conduit wire and pipe msut be individually fit and assembled in situ. Much of the machinery and structural steel for assembling the caster arrives at the site as thousands of pieces somewhat like a giant "erector set" and, like an erector set, must be painstakingly fitted together on site, frequently under less than ideal conditions. The field forces required to assemble this complicated detailed caster assembly are a major cost item, as well as a major disruptive element in a working steel plant. As a result, continuous slab casters and the like require long consruction periods and massive financing efforts and are effectively beyond themeans of small producers, both timewise and costwise.

I have invented a continuous casting plant assembly which drastically reduces the time and cost of field assembly. My continuous caster assembly is placed on a single flat slab, eliminating the massive tunneled and roomed underfloor support structure of the prior art. The continuous caster of this invention is made up of multiple modules, each shop assembled and tested which are moved into place on the flat slab and in effect "plugged in" to adjacent assembled units without any need for complex in field wiring and piping. This reduces the preoperational testing of the facility to about 15% of that normally required in prior art caster assemblies and permits a shortened, simplified field schedule of about 3 months duration involving the placement of a flat slab of concrete and the placement and connection of the preassembled modules. This is compared to the year or more involved in prior art caster assembly.

The caster of the present invention also has the advantage of fitting into most teeming aisles of existing steel plants and thus makes possible the use of existing buildings and cranes. In prior art casters this way not generally possible, thus requiring new buildings and new cranes, increasing the cost and time delay.

In the present invention all caster assemblies are independent modules that are complete with utility piping and wiring. All modules have been assembled and aligned with all associated modules prior to leaving the manufacturer. The straightening section module with integral flume channel has a number of driven rolls to transport the slab, and the short top or bottom feeding starter bar. All driven rolls are equipped with a pair of cylinders, which permit these rolls to close onto the bottom driven rolls to pinch and transport the ½ inch thick starter bar. Additional segment modules contain the slab through the solidification point.

The starter bar handling and charging device is an independent module which loads the plate type starter bar onto itself. When disconnected, the rotating frame places the starter bar charging car into a horizontal position on the casting floor for starter bar head service, and to permit travel to the mold for starter bar feeding. The handling and charging device permits top and/or bottom feeding.

The enire module caster can be completely assembled and aligned inany shop of a size with sufficient crane capacity. No machine component is left for field labor assembly. The foundation mounted mold oscillator module has four eccentrics to generate the stroke, but is designed to eliminate all spherical bearings, bushing, pins, links and cam followers normally used for guidance. The mold oscillator permits very high oscillation frequencies, combined with extreme accuracy with virtually no wearing parts.

The oscillator base supports an adjustable segment in a manner permitting initial alignment of the segment by horizontal shifting without rotation, and rotation without horizontal shifting. Final machine alignment work in the field is reduced to checking and minor adjustments of pre-aligned components.

The ladle turret module has an integral base which extends to the single foundation level. The turret is completely shop assembled with the turret bearing, drive assembly, lubrication piping and wiring in place. An additional, non-critical, bolted split is provided to separate the rotatably top from the base for shipment. Field labor need only install the base with built in bearing and rotating drive onto the embedded steel base plate and then place and bolt the rotatable top to the base.

Labor forces are no longer required to field assemble machinery that should have been assembled in the manufacturer's work shop. The modular caster permits work shop assembly, alignment, and customer inspection of the whole caster at the manufacturer's plant before shipment.

The single level casting platform is designed to be prefabricated in modular forms to shift the emphasis from field construction to installation of modular assemblies.

The mold design permits replacement of the mold jacket cartridge independent of the mold fame. Mold width can be automatically adjusted while casting.

The tundish car is designed to lift and lower the tundish for tundish mozzle insertion, to transfer the tundish in and out of the casting position and permit nozzle alignment with the molds. The large capacity tundish is equipped with throttling slide gates and has dams and weirs to promote floatout of impurities. the tundish car also carries a part of the ladleman's platform which extends the modular floor mounted platform that carries the ladle shroud handler.

Additional modules for the torch cut-off equipment and the runout tables complete the machine installation.

Some of the advantages of the ultra low head caster are lost if a vertical, straight mold caster or large radius caster is desired, but the general application and major benefits of the modular concept still apply.

Utility systems such as the electrical system, hydraulic system, water systems and instrumentation, are completely assembled in the form of system modules which we refer to as utility modules. The electrical system motor control room will be completely assembled at the manfacturer in a shippable module that can be placed near the caster. Hydraulic system pumps, tanks, filters, etc., all equipment normally found in a hydraulic room, will be assembled by the hydraulic system supplier, inside a shippable module, which is then placed near the caster. Water systems and instrumentation system will get the same treatment, so that all assembly and checkout is performed by the experts at point of manufacture, instead of by the field labor forces. The checked and tested control pulpit module is installed on the casting platform.

The utility modules and machinery modules are connected together by interconnecting modules which connect the various points on the machinery modules requiring coolant, electricity and hydraulic fluid to the sources in the utility modules.

The installation of the machinery modules, the interconnecting modules and the utility modules, which arrive at the job site in a virtually ready to operate condition, eliminate on site construction projects in favor of building block type installations.

The installation of interconnecting piping and wiring in the field typically takes a very long time and is extremely costly. Modular planning eliminates about 90% of all field installation of interconnecting wiring and piping. These modules which I have elected to call the interconnecting modules are shippable, fabricated steel frames which are installed on the foundationmat near the machine components. They carry all the utility service lines and components in modular form. Interconnecting modules extend the utility lines along the casting machine by connecting to each other in series, and provide easily serviceable connections between the utility lines and the ultimate users on the machine. The only field work outside of the modular scope of coverage consists of the installationof the utility service line connecting the various utility modules tothe interconnecting units. Transmission of electrical power, spray water, cooling water, compresse air, hydraulic fluid and lubrication grease is now accomplished through connectable, free standing units, which are shipped to the job site as pretested modules.

I provide a modular continuous slab caster and the like made up of an elongate flat foundation mat for supporting the assembly, a ladle turret module including a ladle turret base having a rotatable ladle turret frame mounted on the top, an overhead single level casting platform frame on said foundation mat extending froma poitn adjacent the turret base lengthwise of the mat, a tundish module including a track supported transversely of said casting platform frame adjacent the ladle the ladle turret frame, a tundish car and a tundish movable into position onsaid car beneath a ladle in the ladle turret module, a mold oscillator module including a caster base frame, an adjustable slab mold removably fastened to said mold oscillator, at least one adjustable segment module removably carried within the mold oscillator, a straightening module supported on said flat foundation mat and made up of a frame and a plurality of successive segment top frames on said frame, a starting bar handling and changing module adjacent the casting platform frame end remote from the ladle turret and having a starter bar handling frame adjoining the casting platform frame, a starter bar charging car, a starter bar charging car carrier pivotally mounted on said starter bar handling frame for rotating said charger car between a vertical and a horizontal position in line with a trackway on the casting platform frame, and an interconnecting module on said foundation mat adjacent the casting machine modules and carrying prewired and preplumbed electrical and fluid line with flexible plug-in connectors matching corresponding plug-in connectors in each module of the caster. Preferably the elongate flat foundation is of cast concrete with embedded steel support plates located on a single elevation with the mat surface to receive the separate modules. The mold oscillator module is preferably U-shaped so that one side is open for removal and insertion of the segment modules and the straightening module. Preferably the straightening module base frame is provided with a series of slots beneath the successive segment roll groups and with vertical slots extending from said continuous slot between each succesive segment roll groups to permit expansion and contraction of the frame without distortion and/or resulting misalignment. The rotatable turret frame is preferably mounted on an annular bearing ring and driven by an electricmotor and pinion drive engaging a ring gear as part of the rotating race of the annular bearing. The slab mold may be either a curved or a straight mold, however, if a straight mold is used the segment modules is substantially straight and is followed by a bending segment module to progressively bend the product. Preferably, the starter bar is a plate type bar and the charging car includes a rotating arm for rotating the starter bar assembly from a pick up position to a feed position. The straightening module is preferably provided with a number of pairs of driven rolls, each pair having cylinders to move rolls toward and away from each other. The first segment support in the mold oscillator module is preferably made in two sections, a top part and a bottom pat, the top part rotatable relative to the bottom part about a horizontal axis and the whole first segment suppor being horizontally shiftable to permit ease of alignment of the first segment module with the mold and the straightening module. Preferably the tundish car includes a lifting mechanism for raising and lowering the tundish to transfer the tundish in and out of casting position and permit nozzle alignment with the mold.

In the foregoing general description I have set out certain objects, purposes and advantages of this invention. Other objects, purposes adn advantages of the invention will be apparent from a consideration of the following description and accompanying drawings in which.

Figure 1A:
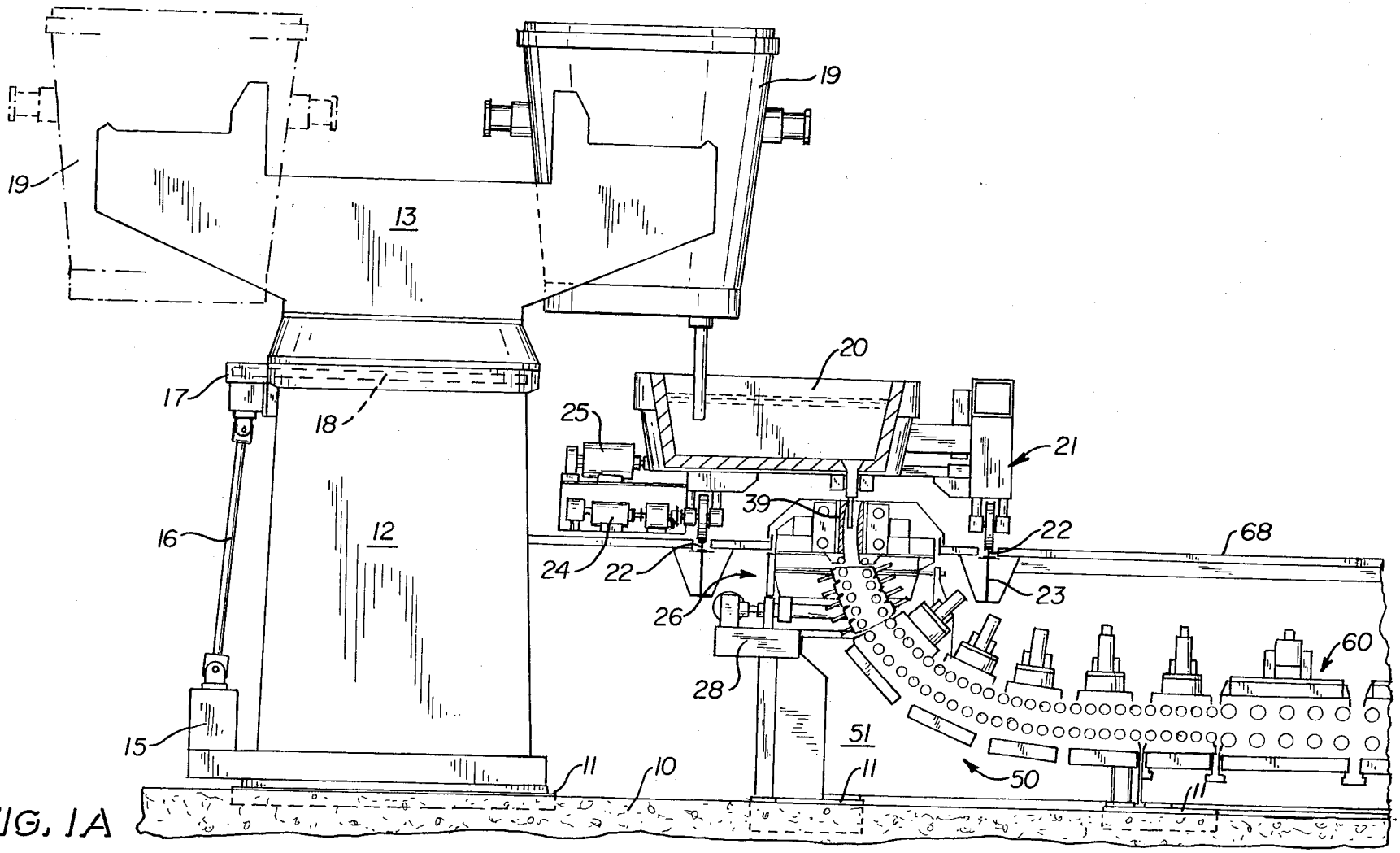
FIGS. 1A and 1B are a side elevation of a curved mold modular continuous slab caster according to this invention.
Figure 1B:
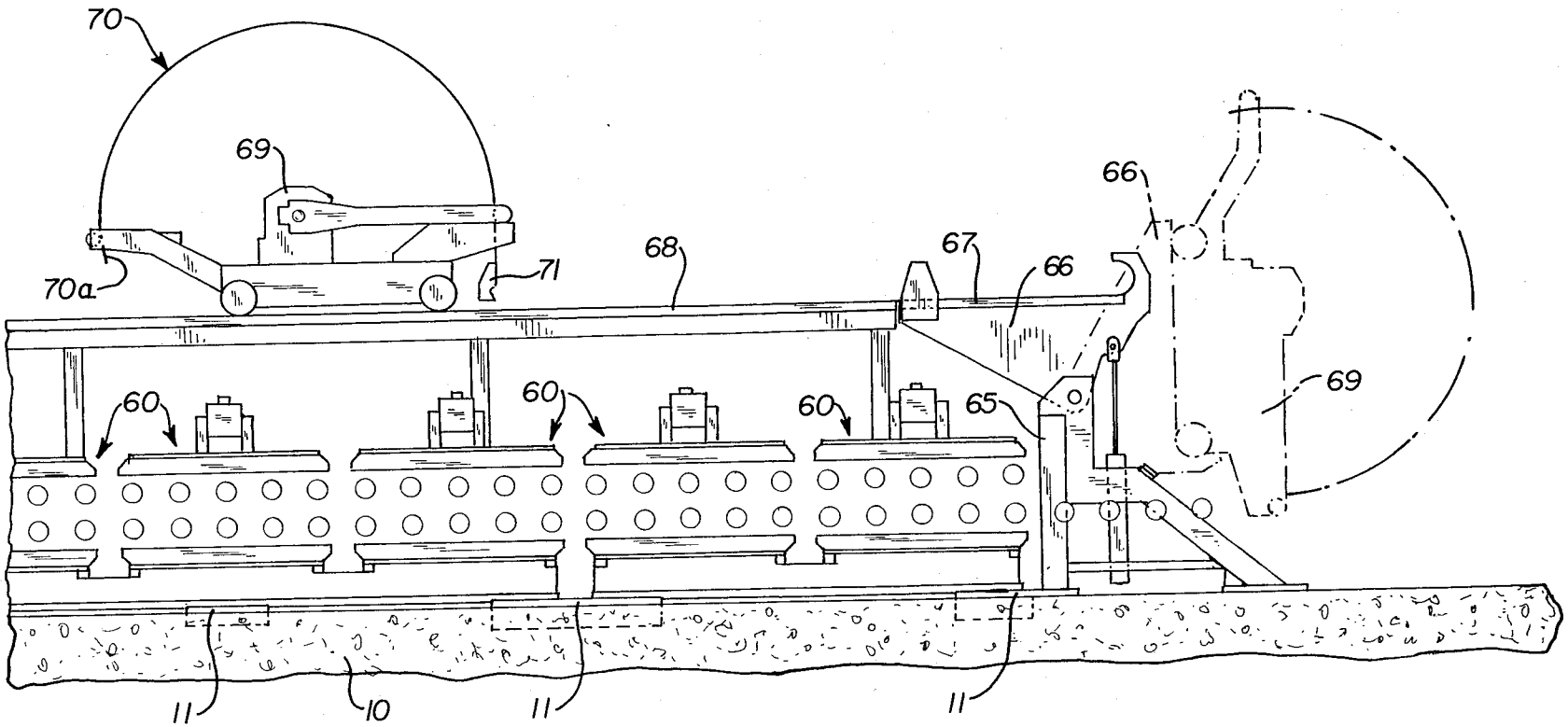
Figure 2:
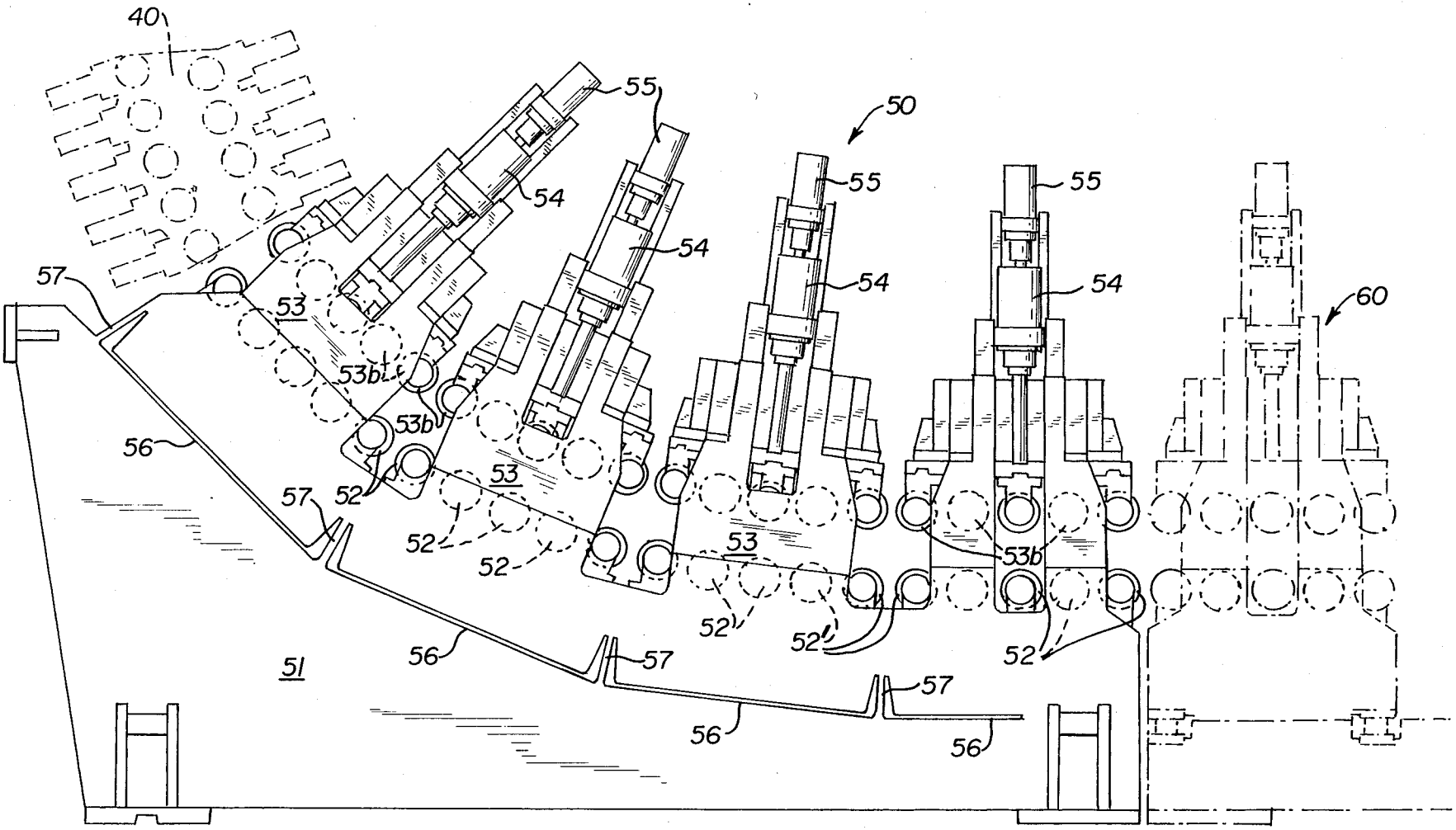
FIG. 2 is a side elevational view of the straightener module of FIG. 1A.
Figure 3:
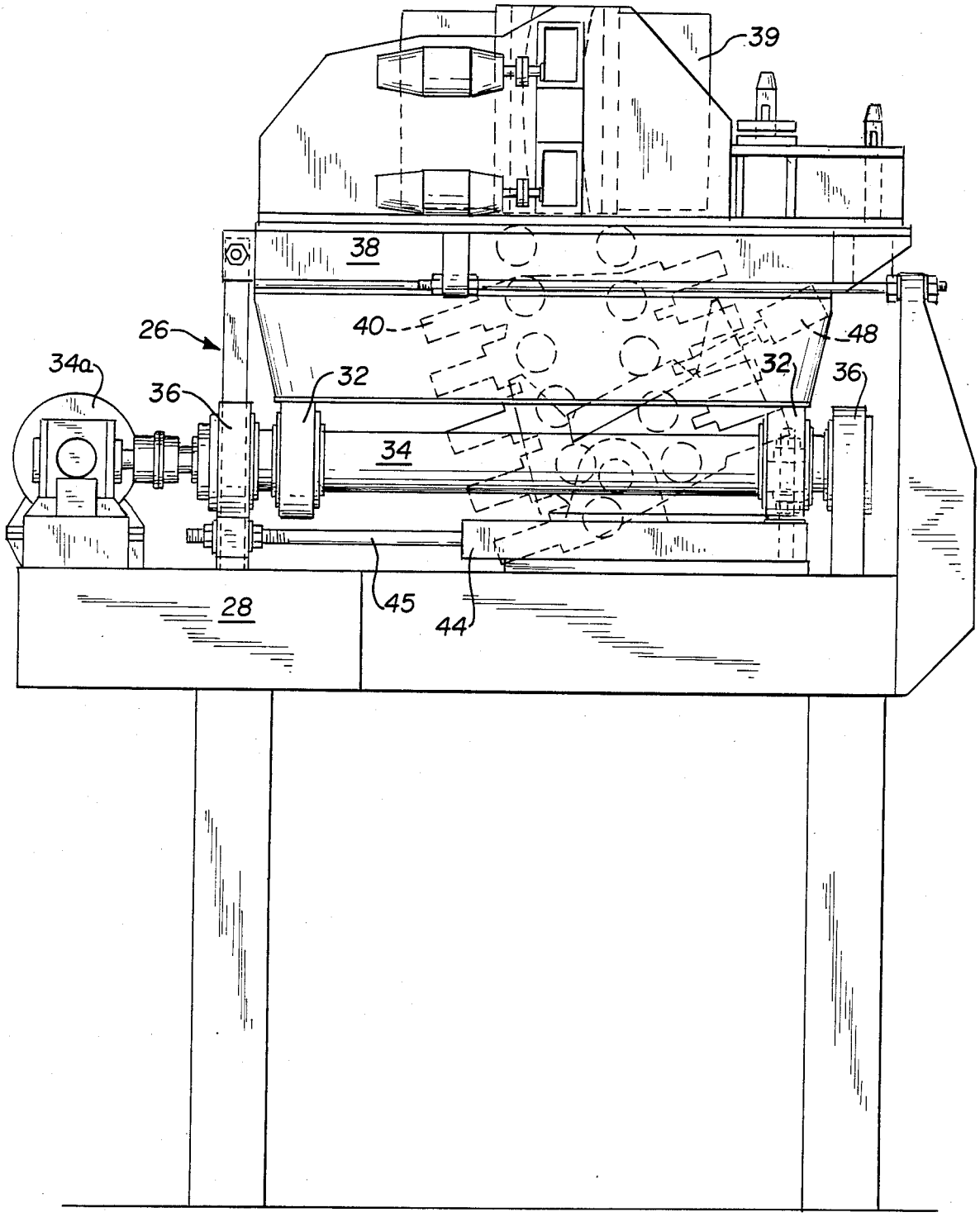
FIG. 3 is a side elevational view of the mold module and oscillator module with an adjustable segment module therein in chain line.
Figure 4:
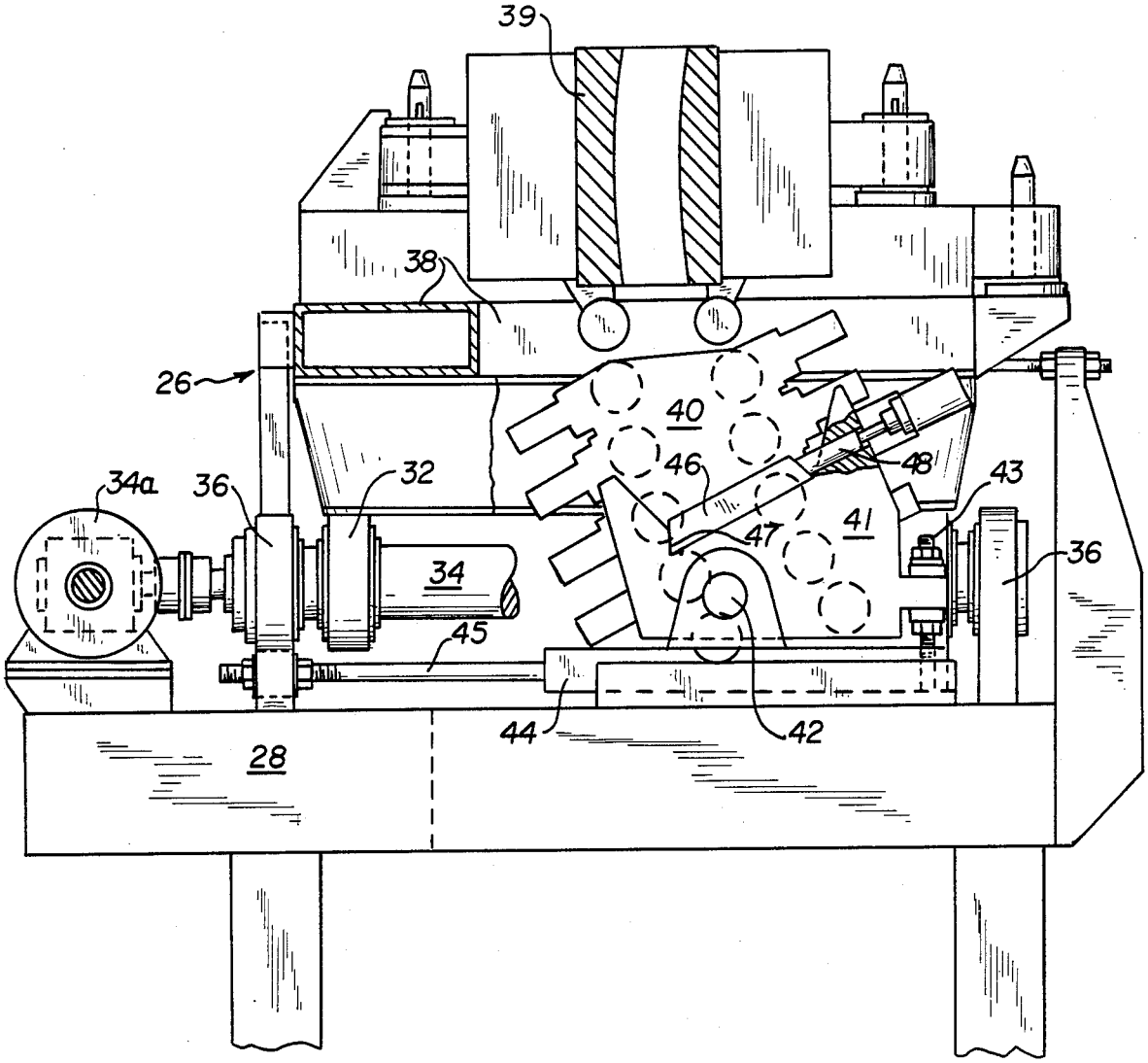
FIG. 4 is a sectional view, partly in elevation the structure of FIG. 3.
Figure 5:
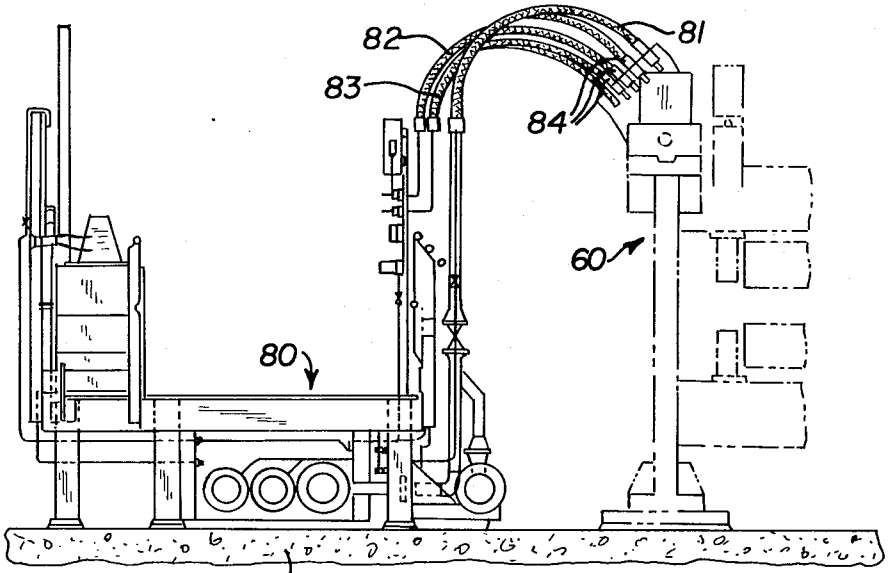
FIG. 5 is an end elevation of the interconnect module for the curved mold assembly of FIGS. 1A and 1B.

Referring to the drawings I have illustrated in FIGS. 1 through 9 a curved mold continuous modular slab caster according to this invention. A foundation mat 10 of cast concrete having embedded steel support plates 11 for supporting the modules. A ladle turret module made up of a turret lower base 12 and a rotatable ladle turret frame 13 mounted thereon. The turret base 12 is provided with an annular bearing (not shown) on which the turret frame 13 rotates and is driven by an electric motor (not shown) through gear drive 15 and through drive shaft 16 and pinion 17 engaging ring gear 18 on turret frame 13. The turret frame 13 is adapted to hold a ladle 19 above tundish 20 carried on tundish car 21 running on track 22 supported on casting platform frame 23. The tundish car 21 is driven by motor and gear train 24. The tundish 20 is raised and lowered on tundish car 21 by means of a lift assembly driven by motor 25.

A mold oscillator 26 is mounted on a frame 28 which rests on support pads 11 on the mat 10. The mold oscillator 26 is journaled to 4 eccentrics 32 on shafts 34 which are supported for rotation in bearings 36 mounted on the frame 28. The shafts 34 are driven by a motor and gear box **34*a* mounted on frame 28. The eccentrics 32 act on mold table assembly 38 to oscillate it and the adjustable mold 39 carried thereon. An adjustable segment module 40 is supported on a segment support 41 mounted on trunnions 42 and is pivoted by a screw 43. The segment support 41, trunnions 42 and screw 43 are mounted on a sliding base 44 on the frame 28 and moved by a screw 45. The adjustable segment module 40 is supported on the segment support 41 by means of trunnions 46 on the segment module frame which rests in wedge grooves 47 in segment support member 41 and are locked in the grooves 47 by a hydraulic operated ram 48. The segment module 40 continues the curve of the mold 39**.

A straightening module 50 rests on steel support plates 11 in the concrete mat 10. This module is made up of a base frame 51 carrying all of the bottom rolls 52 of the roller pairs of the straightening segment and a number of top sections 53 which carry the top rolls **53*b* preferably in groups of five. The center roll of each of the top sections and their mating rolls in the bottom section are preferably driven rolls. Each top section also carries two hydraulic cylinders 54, one on each side, that force the top section against spacers (not shown) to provide the proper roll gap between the top and bottom rolls to contain the newly cast slab without squeezing the slab such as might cause internal slab damage. Additional hydraulic cylinders 55** are provided to force the driven top roll onto the driven bottom roll to pinch the plate type starter bar, hereafter described.

The base frame 51 of the straightening module is provided with slots 56 that are located at right angles to a radial line drawn from the center roll of each five roll top sectins 53. The remaining connections between the lower part of the base frame 51 and upper part of the base frame carrying the bottom rolls ar slender columns 57 which will permit heat expansion of the top and bottom parts of the base frame 51 without causing distortion. The direction of the slots is generlly tangential to the casting radius prevalent at each group of rolls. This slot direction assumes that any expansion of roll groups will occur parallel to the casting radius and thus will cause no misalignment. This design eliminates the need for conventional segment carriers used on conventional casters.

The straightening module 50 is followed by added strand guide modules 60 which carry the slab to run out tables and cut off equipment of conventional form.

At the end of the strand guide modules 60 is provided a starting bar handling and charging module made up of a vertical frame 65 having a startter bar charging car carrier 66 pivoted thereon. The starter bar charging car carrier 66 is provided with a trackway 67 which matches a trackway 68 on the casting platform frame. The charging car carrier 66 pivots from a position in which the trackway 67 and charging car 69 thereon are in a vertical position (shown in chain line in FIG. 1B) to a horizontal position in which the charging car 69 is movable onto trackway 68 to a position adjacent adjustable mold module 39 where the leader **70*a* of the starter bar 70 can be fed into the mold module 39. The plate type starter bar 70 (hereafter described) is fed into the mold module 39 by feeding leader 70*a* through the first segment rolls into the driven rolls of the straightening section until the starter bar head 71 is located in the mold module to engage the liquid steel being poured into the mold. The chilling liquid steel will solidify around the claw type starte bar head 71. The driven rolls of the straightening section will then transport the starter bar assembly with starter bar head 71** in tow through the system to engage the forward end of the semimolten slab coming through the segment module.

The interconnecting modules 80, which are placed alongside the caster modules on the foundation mat 10. These modules are provided with flexible water 81, hydraulic 82 and electrical lines 83 with quick connector ends 84 for attachment to each component of the caster modules. These interconnecting modules carry all valving for the hydraulic and coolant systems as well as all field instrumentation and a grease system. Each interconnecting module is of a shippable size and are preassembled at the factory.

The main feed lines for all utilities are brought to theinterconnecting modules by utilitymodules 85. The utility modules contain the input systems forall the utilities such as water systems for filtration, cooling and pumping air compressors for cooling air, hydraulic systems including tanks, pumps, filters, accumulators, heaters and coolers. Utility modules are assembled at the factory in shippable sizes and are placed with respect to the interconnecting modules, to provide the shortest and least complicated connections between them.

A control plupit module 100, generally located on top of the casting floor, is provided with the necessary controls for controlling the functions of the utility and interconnecting modules as well as all controlling and monitoring devices for the casting modules and the various other modules of the continuous casting assembly.

Figure 10:
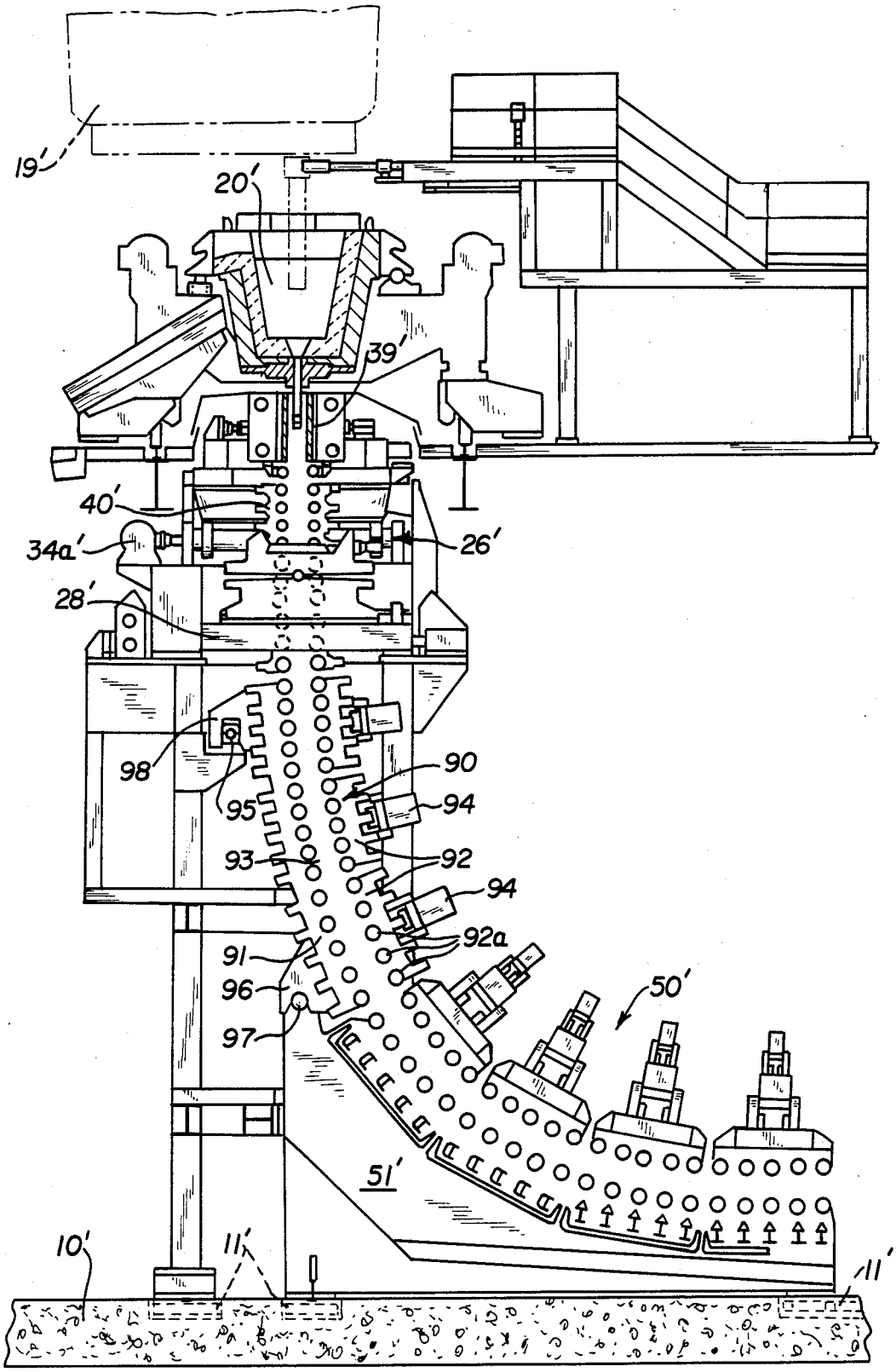
FIG. 10 is a side elevation of a straight mold oscillator module, a straight adjustable segment, a curved adjustable segment and a straightener segment according to a second embodiment of this invention.
Figure 11:
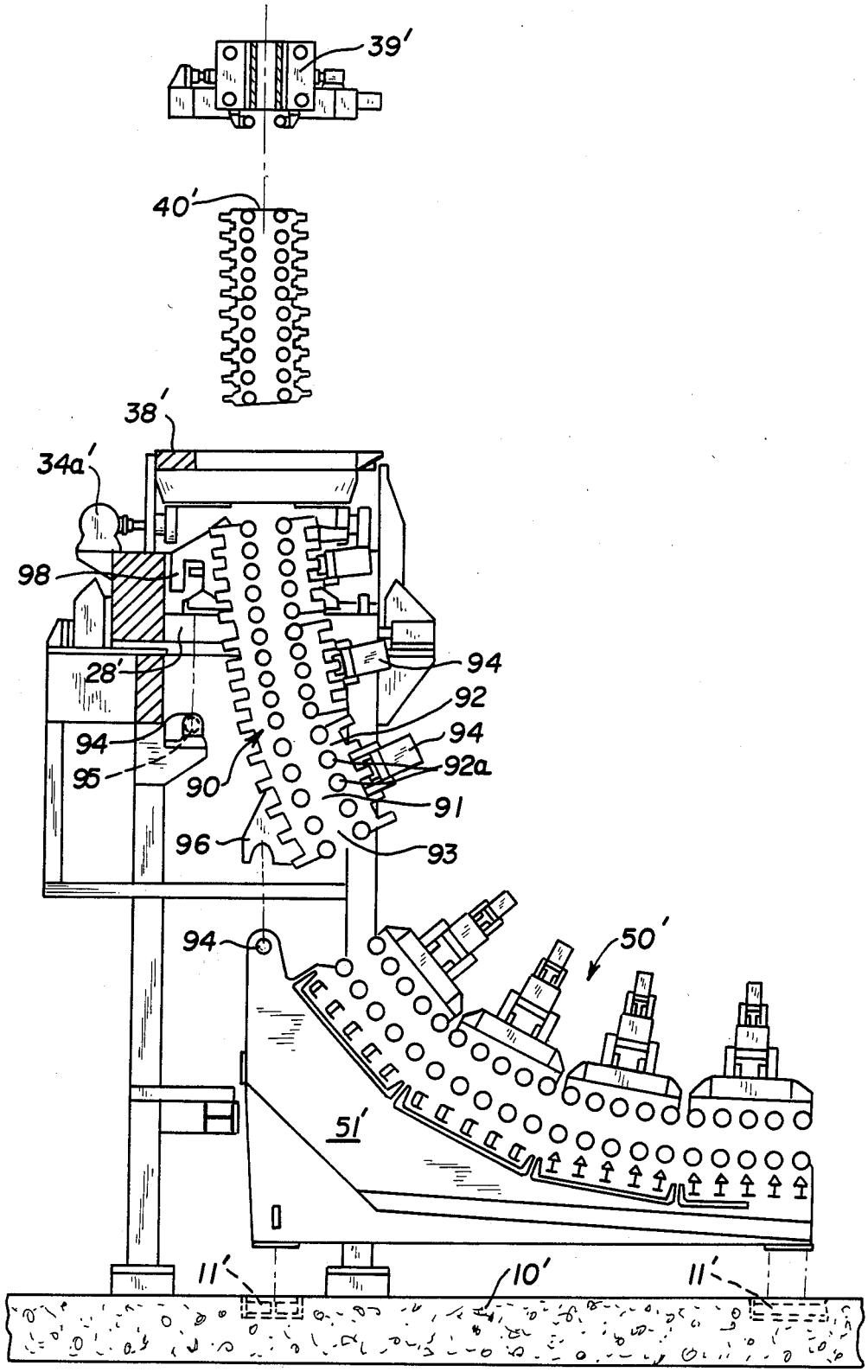
FIG. 11 is an exploded side elevation of the straight mold caster of FIG. 9.

In FIGS. 10 and 11, I have illustrated a similar module caster for use with a straight mold. This is essentially the same as that illustrated in FIGS. 1 through 9 except for being higher and requiring the use of a second curved adjustable segment. In this structure those elements corresponding to elements of FIGS. 1–9 are given the same identifying numbers with a prime sign.

In the embodiment of FIGS. 10 and 11 the mold 39' is straight instead of curved as is also the first segment module 40'. In this embodiment I add a bending adjustable module 90 whch is made up of a frame 91 carrying segments 92 with rolls 92a, each top segment is adjustable by means of cylinders 94 to close down on the starte bar. The bending segment 93 is supported at its lower end by hooks 96 on pins 97. The upper part of the bending segment 93 is guided by hookd 98 that engage parallel sided blocks 94 located wtihpins 95. The guiding surfaces of these blocks are parallel to the path of the slab at that location so that any heat expansion of the bending segment 93 will not cause misalignment between rolls of the straight first segment and the upper rolls of bending segment 93.

Figure 6:
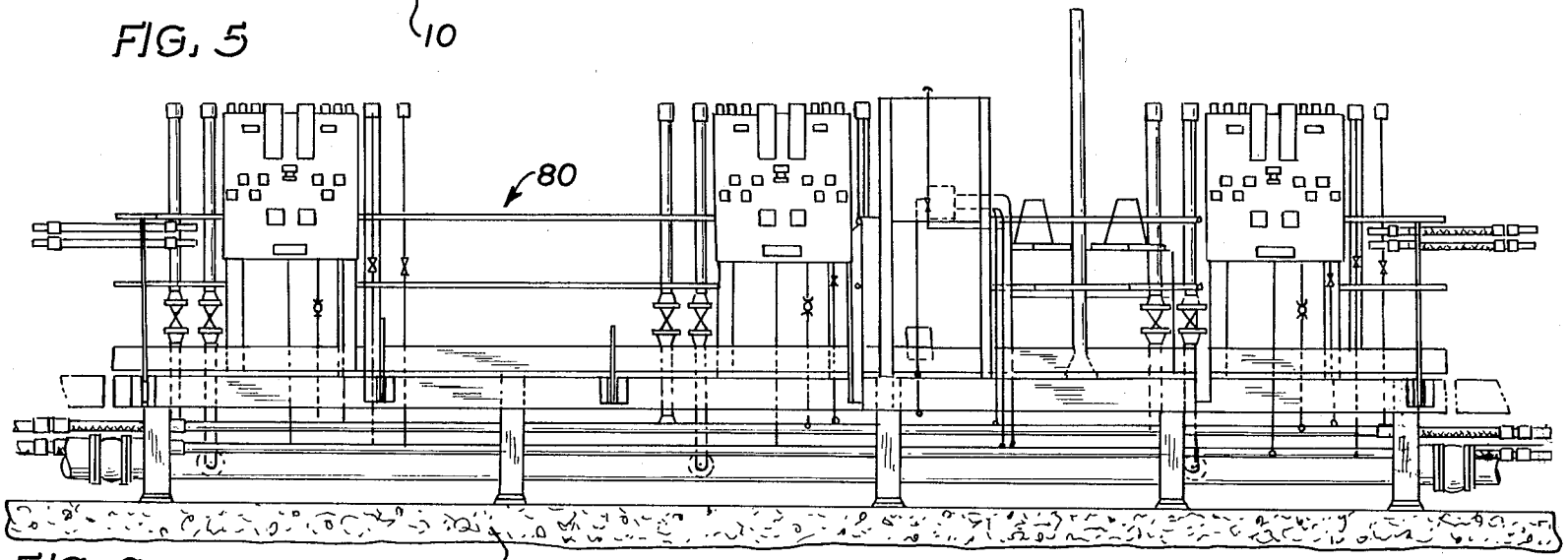
FIG. 6 is a side elevation of the interconnect module of FIG. 5.
Figure 8:
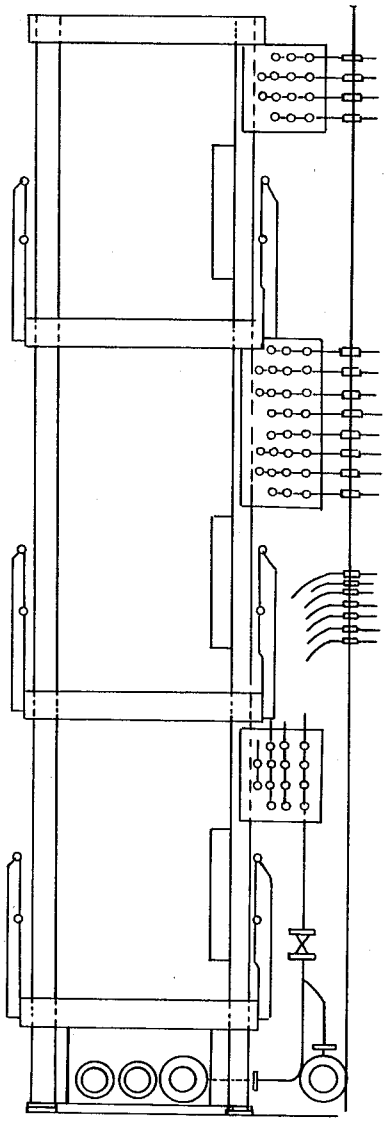
FIG. 8 is an end elevation of the interconnect module of FIG. 7.
Figure 7:
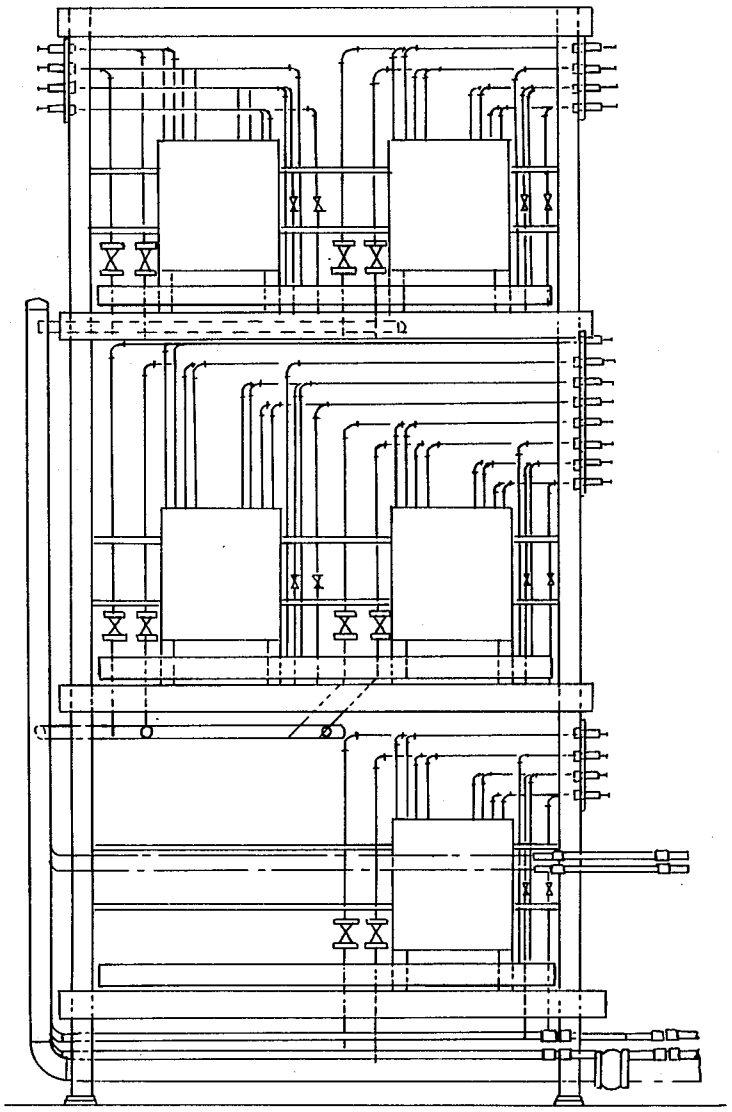
FIG. 7 is a side elevational view of the interconnect module for a straight mold modular caster.
Figure 9:
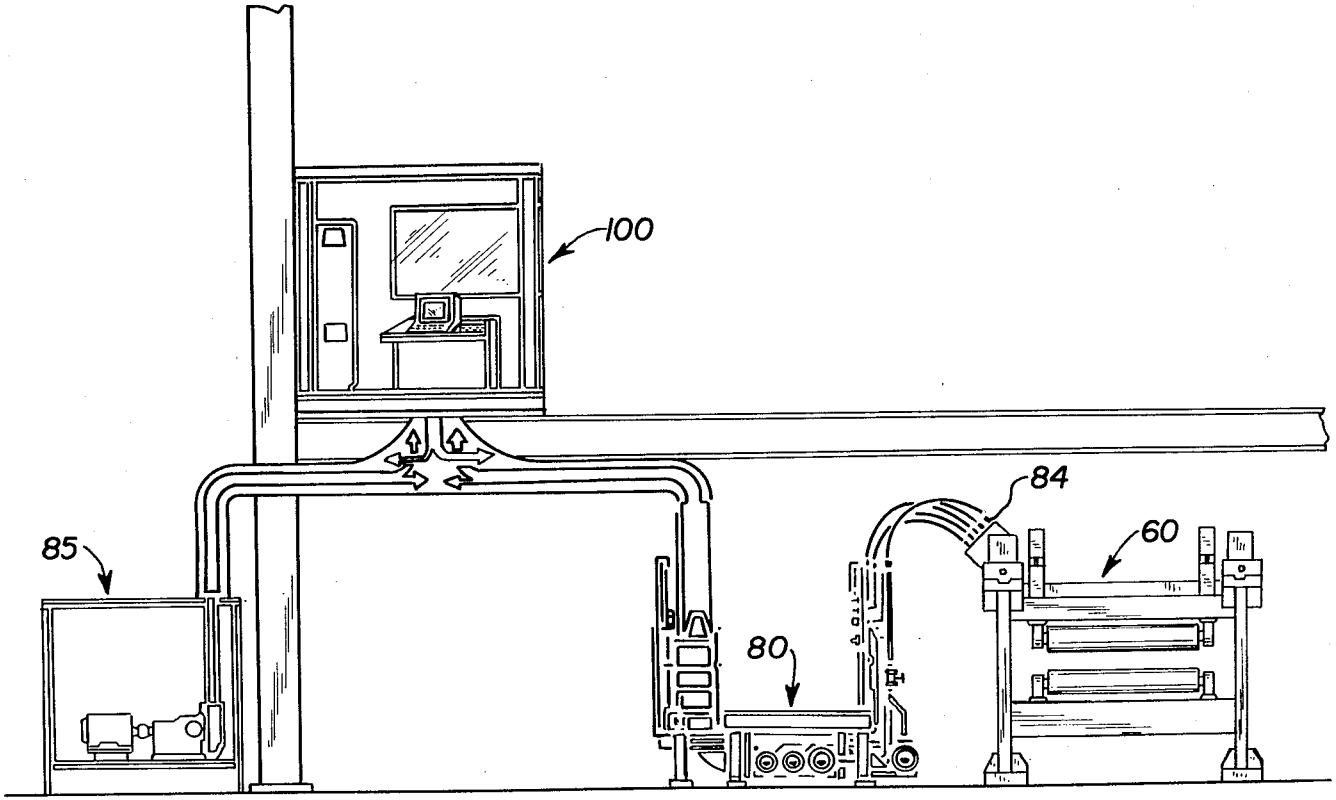
FIG. 9 is a section through a modular caster assembly of this invention showing the utility module, control pulpit module, interconnecting module and the caster module.

This embodiment is provided with an interconnecting module, FIG. 6 and FIG. 7, of the same form as that used with the curved mold embodiment except for being higher at the mold module to accommodate the greater height of the mold and segments at that point.

In the foregoing specification I have set out certain preferred practices and embodiments of this inveniton, however, it will be understood that this invention may be otherwise embodied within the scope of the following claims.

I claim:

1. A modular caster assembly for continuously casting molten steel comprising a foundation for supporting said assembly, a ladle turret module including a ladle supported by a ladle turret base having a rotatable ladle turret frame on the top of said base, a tundish module including tundish means movable into position beneath said ladle, a mold oscillator module including an oscillator base frame and a mold oscillator on said frame, an adjustable mold for molten steel removably fastened to said mold oscillator module, at least one segment module removably disposed beneath said mold for initially receiving steel from said mold, a straightening module for receiving steel from said segment module, a starting bar handling and charging module, and interconnecting module means carrying prewired and preplumbed electrical and fluid lines with plug-in connectors matching corresponding plug-in connectors in each module of said assembly.

2. A modular continuous slab caster and the like comprising an elongate flat foundation mat for supporting the assembly, a ladle turret module including a ladle turret base having a rotatable ladle turret frame mounted on the top, an overhead single level casting platform frame extending from a point adjacent the turret base lengthwise of the mat, a tundish module including a track supported transversely of said casting platform frame adjacent the ladle turret frame, a tundish car and a tundish movable into position on said car beneath a ladle in the ladle turret module, a mold oscillator module including an oscillator base frame adjacent and beneath the tundish track, a mold oscillator on said caster base frame, an adjustable slab mold removably fastened to said mold oscillator module, at least one first segment module removably carried within the mold oscillator module, a straightening module supported on said flat foundation mat and made up of a frame and a plurality of successive top segments on said frame, a starting bar handling and charging module adjacent the casting platform frame end remote from the ladle turret base, and a plurality of interconnecting modules on said foundation mat adjacent the casting machine modules and carrying prewired and preplumbed electrical and fluid lines with flexible plug-in connectors matching corresponding plug-in connectors in each module of the caster.

3. A modular continuous slab caster and the like as claimed in claim 2 wherein the elongate flat foundation mat is of cast concrete with embedded steel plates located on a single elevation with the mat surface whereby said plates receive the separate modules.

4. A modular continuous slab caster and the like as claimed in claim 2 wherein the mold oscillator module is of U-shaped form so that one side is open for removal and insertion of the first segment and the straightening module.

5. A modular continuous slab caster and the like as claimed in claim 2 wherein the straightening frame is provided with a continuous slot beneath each of the successive top segments and with vertical slots between each successive segment carrier to permit expansion and contraction of the frame without distortion and resulting misalignment.

6. A modular continuous slab caster and the like as claimed in claim 2 wherein rotatable ladle turret frame is mounted on an annular bearing ring on the top of the ladle turret base and is driven by an electric motor and a pinion drive engaging a ring gear at the base of the ladle turret frame, said frame being separable at a point between the top and bearing whereby said frame may be separated into two parts for shipping without disturbing the bearing.

7. A modular continuous slab caster and the like as claimed in claim 2 wherein the adjustable slab mold is a curved mold and the segment module is curved.

8. A modular continuous slab caster and the like as claimed in claim 2 wherein the adjustable slab mold is a straight mold and the segment module is substantially straight followed by a second curved segment module.

9. A modular continuous slab caster and the like as claimed in claim 2 wherein the starter bar charging car includes a rotating arm for rotating the starter bar assembly from a pick up position to a feeding position.

10. A modular continuous slab castern and the like as claimed in claim 2 wherein the interconnecting modules have input and output ports to be connected to utility modules and to adjacent interconnecting modules providing electrical and fluid lines.

11. A modular continuous slab caster and the like as claimed in claim 2 wherein the starter bar is a plate type bar.

12. A modular continuous slab caster and the like as claimed in claim 2 wherein the straightening module is provided with a plurality of driven rolls, each pair of driven rolls having cylinders to move said rolls toward and away from each other to engage a thin plate starter bar.

13. A modular continuous slab caster and the like as claimed in claim 2 wherein the mold oscillator module ahs four eccentrics to generate the necessary stroke for oscillation.

14. A modular continuous slab caster and the like as claimed in claim 2 wherein the mold oscillator module is horse shoe shaped with one side open to permit vertical removal of the strand guide systems modules.

15. A modular continuous slab caster and the like as claimed in claim 2 wherein the mold oscillator is made in two parts, consisting of an oscillator base section and a mold table supported thereon and having a first segment support member slidable horizontally and rotatably supporting the first segment.

16. A modular continuous slab caster and the like as claimed in claim 2 wherein the tundish car includes a lifting mechanism for raising and lowering the tundish to transfer the tundish in and out of casting position and permit nozzle alignment with the molds.

17. A modular continuous caster as claimed in claim 3 or 4 wherein the rotatable ladle turret frame is mounted on an annular bearing ring on the top of the ladle turret base and is driven by an electric motor and a pinion drive engaging a ring gear at the base of the ladle turret frame.

18. A modular continuous caster as claimed in claim 17 wherein the adjustable slab mold is a curved mold and the segment module is curved.

19. A modular continuous caster and the like as claimed in claim 17 wherein the adjustable slab mold is a stright mold and the segment module is substantially straight followed by a second curved segment module.

20. A modular continuous caster and the like as claimed in claim 17 wherein the starter bar charging car includes a rotating arm for rotating the starter bar assembly from a pick up position to a feeding position.

* * * * *

UNITED STATES PATENT AND TRADEMARK OFFICE

CERTIFICATE OF CORRECTION

PATENT NO. : 4,799,535

DATED : January 24, 1989

INVENTOR(S): Herbert Lemper

It is certified that error appears in the above-identified patent and that said Letters Patent is hereby corrected as shown below:

Column 1 Line 5 "isa" should read --is a--.

Column 1 Line 26 "in situ" should read italicized.

Column 1 Line 37 "themeans" should read --the means--.

Column 1 Line 59 "way" should read --was--.

Column 2 Line 15 "inany" should read --in any--.

Column 2 Line 35 "rotatably" should read --rotatable--.

Column 2 Line 51 "fame." should read --frame.--.

Column 2 Line 54 "mozzle" should read --nozzle--.

Column 2 Line 58 "the" should read --The--.

Column 3 Line 33 "foundationmat" should read --foundation mat--.

UNITED STATES PATENT AND TRADEMARK OFFICE

CERTIFICATE OF CORRECTION

PATENT NO. : 4,799,535

DATED : January 24, 1989

INVENTOR(S) : Herbert Lemper

It is certified that error appears in the above-identified patent and that said Letters Patent is hereby corrected as shown below:

Column 3 Line 41 "installationof" should read --installation of--.

Column 3 Line 42 "tothe" should read --to the--.

Column 3 Line 44 "compresse" should read --compressed--.

Column 3 Line 54 "froma poitn" should read --from a point--.

Column 3 Line 58 "onsaid" should read --on said--.

Column 4 Line 24 "electricmotor" should read --electric motor--.

UNITED STATES PATENT AND TRADEMARK OFFICE

CERTIFICATE OF CORRECTION

PATENT NO. : 4,799,535

DATED : January 24, 1989

INVENTOR(S) : Herbert Lemper

It is certified that error appears in the above-identified patent and that said Letters Patent is hereby corrected as shown below:

Column 4 Line 39 "pat," should read --part,--.

Column 4 Line 41 "suppor" should read --support--.

Column 4 Line 50 "adn" should read --and--.

Column 6 Line 4 "sectins" should read --sections--.

Column 6 Line 6 "ar" should read --are--.

Column 6 Line 21 "startter" should read --starter--.

Column 6 Line 38 "starte" should read --starter--.

Column 6 Line 54 "theinterconnecting" should read --the interconnecting--.

Column 6 Line 54 "utilitymodules" should read --utility modules--.

UNITED STATES PATENT AND TRADEMARK OFFICE

CERTIFICATE OF CORRECTION

PATENT NO. : 4,799,535

DATED : January 24, 1989

INVENTOR(S) : Herbert Lemper

It is certified that error appears in the above-identified patent and that said Letters Patent is hereby corrected as shown below:

Column 6 Line 55 "forall" should read --for all--.

Column 7 Line 16 "starte" should read --starter--.

Column 7 Line 18 "hookd" should read --hooks--.

Column 7 Line 19 "wtihpins" should read --with pins--.

Claim 13 Column 8 Line 66 "ahs" should read --has--.

Signed and Sealed this

Twenty-fifth Day of July, 1989

*Attest:*

*Attesting Officer*

DONALD J. QUIGG

*Commissioner of Patents and Trademarks*